US011391042B2

(12) United States Patent
Den Daas et al.

(10) Patent No.: US 11,391,042 B2
(45) Date of Patent: Jul. 19, 2022

(54) DRY STACKING SYSTEM

(71) Applicant: Wienerberger BV, Zaltbommel (NL)

(72) Inventors: Gert Jan Den Daas, Zaltbommel (NL); Walter Bierens, Zaltbommel (NL); Stef Van Ham, Zaltbommel (NL); Sebastian Van Droogenbroeck, Zaltbommel (NL); Rob Van Der Pluijm, Zaltbommel (NL); Rob Mulder, Zaltbommel (NL)

(73) Assignee: Wienerberger BV

( * ) Notice: Subject to any disclaimer, the term of this patent is extended or adjusted under 35 U.S.C. 154(b) by 0 days.

(21) Appl. No.: 17/120,070

(22) Filed: Dec. 11, 2020

(65) Prior Publication Data

US 2021/0180318 A1 Jun. 17, 2021

(30) Foreign Application Priority Data

Dec. 11, 2019 (BE) ..... 2019/5888

(51) Int. Cl.
*E04B 2/00* (2006.01)
*E04B 2/28* (2006.01)
(Continued)

(52) U.S. Cl.
CPC ..... *E04B 2/28* (2013.01); *E04B 1/4178* (2013.01); *E04B 2002/0254* (2013.01)

(58) Field of Classification Search
CPC ... E04B 1/4178; E04B 2002/0254; E04B 2/28
See application file for complete search history.

(56) References Cited

U.S. PATENT DOCUMENTS 1,567,085 A * 12/1925 Rowland ..... E04B 2/18 52/605
2,049,907 A * 8/1936 Hess ..... E04C 1/39 52/375

(Continued)

FOREIGN PATENT DOCUMENTS

EP 1412588 B1 11/2011
FR 1008452 A 5/1952

(Continued)

OTHER PUBLICATIONS

Search report for Belgian application BE-2019/5888; dated Jul. 23, 2020.

(Continued)

*Primary Examiner* — Basil S Katcheves
(74) *Attorney, Agent, or Firm* — Fresh IP PLC; Clifford D. Hyra; Aubrey Y. Chen

(57) ABSTRACT

The invention concerns a dry stacking system (1) comprising:

bricks (2, 3, 4, 5, 27, 29), with a flat top face (8) and a flat bottom face (9) in which a groove (14, 15) is provided in the length direction;

a wall tie (6); and an anchoring clamping element (7) which can be attached to the wall tie (6) and in adjacent grooves (14, 15) of a top-stacked brick (2, 3, 4, 5, 27, 29) and a corresponding under-stacked brick (2, 3, 4, 5);

wherein at least one brick (2, 29) as an anchoring brick (2, 29) has one or more recesses (16) in its top face (8) and/or its bottom face (9) for receiving the wall tie (6) therein, wherein each recess (16) extends from a rear face (10) to beyond the corresponding groove (14).

(Continued)

The invention also concerns an anchoring brick (2, 29) for such a dry stacking system (1), a facade (26) erected therewith, and a method for erecting such a facade (26).

13 Claims, 6 Drawing Sheets

(51) Int. Cl.
*E04B 1/41* (2006.01)
*E04B 2/02* (2006.01)

(56) References Cited

U.S. PATENT DOCUMENTS 2,225,612 A * 12/1940 Allen ..... E04F 15/04 52/586.2
2,963,828 A * 12/1960 Belliveau ..... E04B 2/08 52/564
3,529,390 A * 9/1970 Stetter ..... E04B 2/18 52/285.1
3,546,833 A * 12/1970 Perreton ..... E04B 2/46 52/314
4,498,266 A * 2/1985 Perreton ..... E04C 1/41 52/405.4
4,532,747 A * 8/1985 Koetje ..... B63B 3/18 29/507
4,622,796 A * 11/1986 Aziz ..... E04B 1/7616 52/379
4,833,856 A * 5/1989 Zwagerman ..... B63B 35/38 52/592.1
5,024,035 A * 6/1991 Hanson ..... E04B 2/18 52/309.12
5,402,609 A * 4/1995 Kelley, Jr. ..... B28B 7/183 52/122.1
5,487,623 A * 1/1996 Anderson ..... E02D 29/02 405/286
6,065,265 A * 5/2000 Stenekes ..... E04B 2/46 52/100
6,189,282 B1 * 2/2001 VanderWerf ..... E04B 2/14 52/582.1
7,461,490 B2 * 12/2008 Toledo ..... E04B 2/14 52/293.2
7,591,447 B2 * 9/2009 Hammer ..... B28B 7/0061 249/104
7,762,033 B2 * 7/2010 Scott ..... E04B 2/8629 52/425
7,806,038 B2 * 10/2010 Duke ..... F41H 5/013 89/36.04
9,182,133 B1 * 11/2015 Weber ..... E04C 1/397
9,441,342 B2 * 9/2016 Castonguay ..... E04C 1/395
10,190,313 B1 * 1/2019 Toledo ..... E04B 2/54
10,458,092 B1 * 10/2019 Correia ..... E02D 29/0266
2007/0186502 A1 * 8/2007 Marsh ..... E04B 2/16 52/604
2007/0245660 A1 * 10/2007 Scott ..... E04B 2/10 52/438
2009/0041552 A1 * 2/2009 Hammer ..... E04C 1/395 405/284
2014/0215949 A1 * 8/2014 Cossette ..... E04C 1/41 52/568
2015/0097312 A1 * 4/2015 MacDonald ..... B28B 7/007 264/319
2015/0259910 A1 * 9/2015 Montiel Reyes ..... E04C 1/00 52/604
2016/0024786 A1 * 1/2016 Castonguay ..... E04B 2/34 52/564
2018/0023303 A1 * 1/2018 MacDonald ..... E04F 13/0801 52/386
2018/0266105 A1 * 9/2018 Rodriguez Carassus ..... E04B 2/18

FOREIGN PATENT DOCUMENTS

GB 562154 A 6/1944
WO WO2016023804 2/2016

OTHER PUBLICATIONS

EP Office Action for Application No. 20212156.2, dated Nov. 3, 2021.
Response to EP Office Action for Application No. 20212156.2, dated Mar. 10, 2022, with the amended claims and specification.
Third Party Observations in EP Application No. 20212156.2, Submitted Aug. 20, 2021.
Reply to Third Party Observations in EP Application No. 20212156.2, Mailing Date Oct. 11, 2021, with the amended claims and specification.
"Technische informatie Daas ClickBrick", Daas Baksteen Website, Feb. 3, 2007.

* cited by examiner

DRY STACKING SYSTEM

The invention concerns a dry stacking system with bricks for erection of a façade, comprising:

bricks, wherein each brick has a top face and a bottom face which are configured to be flat such that said bricks can be stacked with bottom faces of top-stacked bricks on top of top faces of under-stacked bricks, and wherein the top face and bottom face of each brick have a groove which extends substantially in the length direction of said brick, such that the groove in the bottom face of each top-stacked brick opens into corresponding grooves in the top face of under-stacked bricks;

a wall tie; and an anchoring clamping element which can be attached to the wall tie and arranged in the adjacent grooves of each top-stacked brick and its corresponding under-stacked bricks.

Said length direction is a direction parallel to the top face and bottom face, and parallel to the rear face and front face. The dimension of such brick in this length direction is typically the largest dimension of such a brick, but this does not need necessarily to be the case.

When erecting a facade with these bricks, the grooves of the bricks which are coupled together by means of said anchoring clamping element also extend along the length direction of this facade.

Using the wall tie, a facade erected with such a dry stacking system can be anchored to a structure at the back in order to conduct the loads into this rear structure perpendicularly to the face of said facade.

Such a dry stacking system is known for example from EP 1 412 588 B1.

Such dry stacking systems offer—in comparison with masonry—the advantage that the system can be re-used in a circular way. This means that after erecting a wall with said dry stacking system, the bricks and anchoring clamping elements are separately and fully recyclable without loss of function.

The solution for dry stacking systems in EP 1 412 588 B1 however can only be used with bricks of fixed dimensions, and in practice is only used with wire-cut bricks. After grinding, such wire-cut bricks have minimal tolerances in both height and length. The solution from EP 1 412 588 B1 is not suitable for erecting facades with bricks in which the length dimension is not fixed, such as e.g. hand-moulded bricks or form casted bricks or water-struck bricks etc.

The object of this invention is to provide such a dry stacking system which is also suitable for erecting facades with bricks whose length dimension is not fixed.

The object of this invention is achieved by the provision of an anchoring brick for such a dry stacking system, comprising a top face and a bottom face which are configured to be flat, wherein the top face and the bottom face each have a groove, wherein the groove in the top face is arranged almost directly above the groove in the bottom face, wherein these grooves extend substantially along the length direction of this anchoring brick and wherein this anchoring brick has one or more recesses in its top face and/or its bottom face for receiving the wall tie, wherein each recess extends from a rear face of said brick to beyond the corresponding groove in the top face or in the bottom face. This has the same advantages and features as summarised below for a dry stacking system according to the present patent application.

This object of the invention is also achieved by the provision of a dry stacking system with bricks, comprising:

bricks, wherein each brick has a top face and a bottom face which are configured to be flat in such a way that said bricks can be stacked with bottom faces of top-stacked bricks on top of top faces of under-stacked bricks, and wherein the top face and bottom face of each brick have a groove which extends substantially in the length direction of said brick, in such a way that the groove in the bottom face of each top-stacked brick opens into corresponding grooves in the top face of under-stacked bricks;

a wall tie; and an anchoring clamping element which can be attached to the wall tie and arranged so as to be clamped in the adjacent grooves of a top-stacked brick and an under-stacked brick;

wherein at least one said brick as an anchoring brick has one or more recesses in its top face and/or its bottom face for receiving the wall tie, wherein each recess extends from a rear face of said anchoring brick to beyond the corresponding groove in the top face or bottom face.

In the prior art, in the erection of a facade using such a dry stacking system, the position of the wall ties is already determined with known intermediate dimensions. The wall tie can then be arranged between adjacent bricks. The length of such bricks however must have a fixed known dimension with limited tolerances. With wall ties, there is limited tolerance in their positioning.

Using an anchoring system with one or more recesses, according to the invention it is now possible to arrange a wall tie in a recess of such an anchoring brick, so that even with differing dimensions of the bricks, the wall tie can always be positioned. Because of the dimensions of the recess in the length direction or by providing several recesses, there are several possibilities for positioning the wall tie in the facade and anchoring it to a structure at the back where structurally possible. With the limited tolerance in positioning of the wall ties, it can be ensured that such a wall tie can always be placed in one of these recesses.

This solution with an anchoring brick with one or more recesses is suitable for the erection of dry stacking systems with bricks of fired clay, such as the above-mentioned hand-moulded bricks, form casted bricks or water-struck bricks, but may also be used with all other types of bricks with which a facade may be produced, such as for example natural stone, concrete bricks and calcium silicate bricks. Such a dry stacking system may also comprise a combination of such bricks.

The top faces and bottom faces of said bricks of a dry stacking system according to the invention may, for example, be made flat, for example by being ground flat.

The grooves may advantageously be produced by forming these as saw cuts. Alternatively, they may also be formed in a mould.

Saw cuts have the advantage that the width of these grooves can be reliably controlled with limited tolerances, in a way that the anchoring clamping element can be clamped very reliably in such grooves when arranged in the grooves.

The grooves preferably extend between the side faces of the bricks, and preferably open into these side faces. The dry stacking system furthermore preferably comprises a locking element which can be arranged in adjacent grooves of bricks standing next to each other, in order to secure these bricks in relation to each other. In this way, it is possible to arrange locking elements in grooves of adjacent bricks in order to secure these bricks in relation to each other. Also, such a locking element may also be provided for engaging both in grooves of top-stacked bricks and in grooves of under-stacked bricks.

Alternatively, the bricks of a dry stacking system according to this invention may also be fastened together in a different way. Thus for example recesses may be provided in the side faces for arranging locking elements therein, for fastening together bricks standing next to each other. Such recesses in the side faces are produced for example as saw cuts or as bores etc.

Said locking elements serve to be able to align the bricks and transfer loads from the facade to the anchoring bricks and thus to the wall ties.

In the case of anchoring bricks produced in a mould, the one or more recesses are preferably also produced in this mould. Alternatively, they may also be produced for example by milling. Milling the recesses may be used above all for example with natural stones.

As well as the anchoring brick with one or more recesses, a dry stacking system according to this invention may for example also comprise plain bricks without such recesses, although they may be provided with similar grooves for helping a locking element to fasten these plain bricks together, or fasten this plain brick to an anchoring brick arranged next to it. Also, separate corner bricks may be produced for forming corners in a facade.

Said one or more recesses each extend from the rear face of the anchoring brick, viewed towards the front face of the anchoring brick, preferably to a safe distance from this front face.

On the front side, the one or more recesses of the anchoring brick are thus delimited by the front upright edge of the anchoring brick. Using such a front upright edge, the wall tie can be concealed when viewed from the front side of this anchoring brick. Depending on the type of brick and the way of forming the front upright edge, this distance may be narrower or wider. The width of the anchoring brick will partly depend on the width of this front upright edge and the depth over which the wall tie may extend into the recesses, so as to be able to anchor the wall tie adequately in the groove by means of the anchoring clamping element in order to transfer the necessary loads via the wall tie to the structure situated at the back.

Even more preferably, said one or more recesses extend from the rear face of the anchoring brick to the front face thereof, preferably to beyond half of the corresponding top face or corresponding bottom face.

The one or more recesses may assume any forms but are preferably each formed substantially bar-shaped. Also, in bricks made in a mould, wherein also the one or more recesses are produced in this mould, such a bar-shaped form may also be provided with a release chamfer.

Such a recess of an anchoring brick of a dry stacking system according to this invention is preferably laterally delimited by upright edges of this anchoring brick. These upright edges are preferably provided, on arrangement of the wall tie in a said recess and on clamping application of the anchoring clamping element in the corresponding groove, to cause said anchoring clamping element to engage in the corresponding groove in the corresponding upright edges on opposite sides of said recess.

The anchoring clamping element must be able to engage in the groove such that the necessary loads can be transferred via the wall tie to the structure situated at the back. Taking account of the desired length of the anchoring brick, with the necessary anchoring of the anchoring clamping element in the groove to be able to absorb the necessary loads (and hence the desired distance of the groove from the rear side of the anchoring brick), the wall tie spacing (between the bricks of the facade to be erected and the structure behind), the diameter of the wall tie and the maximum angle of the wall tie to be able to reach all potential anchoring points in the various recesses in an anchoring brick, the further dimensions of the recesses and the upright edges, viewed in the length direction of the anchoring brick, may be simply calculated further as a function thereof.

When the groove in an upright edge at an end of such an anchoring brick opens in the side face of this anchoring brick so that a said locking element can engage therein, the width of said upright edge is also determined by the dimensions of this locking element.

The depth of each recess should be selected in such a way that the wall tie can be received therein. The dry stacking system may be selected in such a way that the wall tie can be received in a single recess. Alternatively, the wall tie may also be partly received in a first recess in the top face of an under-stacked anchoring brick, and in a second recess in the bottom face of a top-stacked anchoring brick. The depth of the recesses is therefore selected as a function of the diameter of the wall tie and the possible slope of the wall tie.

Each groove preferably has a depth which is deeper than the depth of each recess. This depth is preferably selected in relation to the diameter of the wall tie and the dimensions of the anchoring clamping element to be arranged therein.

By making the groove deeper, it is possible to allow the anchoring clamping element to engage in the corresponding groove not only at the side of the recess but also in the corresponding groove at the bottom of the recess. It is also possible to provide embodiments in which the anchoring clamping element does not engage in the corresponding groove at the side of the recess but only in the corresponding groove at the bottom of the recess.

According to the invention, the one or more recesses may be provided in the top face and/or the bottom face of an anchoring brick. Both bed faces of the anchoring brick may thus be provided with one or more such recesses, or only one of the two laying faces. If the one or more recesses are provided in one of the two laying faces, they are preferably provided in the top face. The top face is visible as the laying face during stacking, so that the wall tie with anchoring clamping element attached thereto can be positioned in a recess in this laying face.

The anchoring clamping element of the dry stacking system according to this invention may have several forms. It may for example be configured like the anchoring clamping elements from EP 1 412 588 B1. A preferred variant is illustrated and described in more detail below.

In a simple embodiment, the anchoring clamping element is provided with an anchor recess in which the wall tie can be arranged so that the anchoring clamping element is attachable to the wall tie. More specifically, the anchoring clamping element may comprise several such anchor recesses in which the wall tie can be arranged, wherein these anchor recesses are spread over the length direction to make the anchoring clamping element attachable to the wall tie in several corresponding positions.

In a dry stacking system according to the invention, one or more bricks may be configured as a hand-moulded brick or form casted brick. If the anchoring brick with the one or more recesses is produced as such a hand-moulded brick or form-casted brick, the one or more recesses are preferably provided in only one laying face of this anchoring brick. It is easier in a mould to produce one or more such recesses only in one laying face of an anchoring brick.

In addition, the object of the invention is also achieved by the provision of a facade erected with a dry stacking system as described above according to this invention, wherein said wall tie of the dry stacking system is arranged in a said recess and wherein said anchoring clamping element is attached to the wall tie and is arranged in grooves corresponding to the recess in top-stacked or under-stacked bricks.

Finally, the object of the invention is also achieved by the provision of a method for erecting a façade, with a dry stacking system as described above according to the invention, wherein said bricks are stacked one above the other, wherein the anchoring brick with said recesses is arranged at the height of said wall tie, wherein the anchoring clamping element is attached to the wall tie, wherein the wall tie is arranged in a said recess, and wherein the anchoring clamping element is arranged in grooves corresponding to the recess in top-stacked or under-stacked bricks.

The invention will now be explained in more detail with reference to the following detailed description of some preferred embodiments of bricks, dry stacking systems, walls and methods according to this invention. The aim of the description is solely to give explanatory examples and to illustrate further advantages and features of the invention, and it may not therefore be interpreted as a restriction of the area of application of the invention or of the patent rights claimed in the claims.

In the detailed description, by means of reference signs, reference is made to the attached drawings in which.

Figure 16:
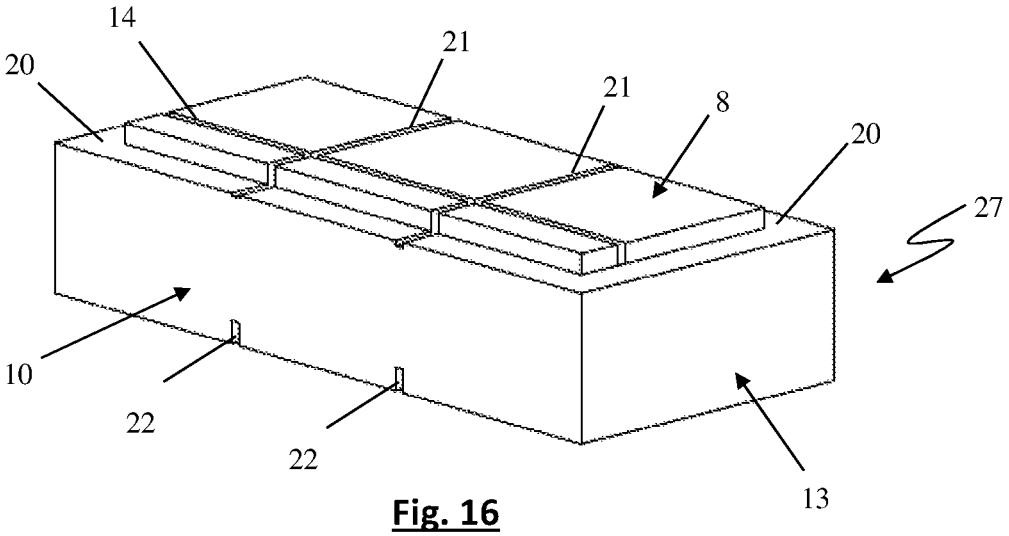
FIG. 16 shows an alternative corner brick for the dry stacking system from FIG. 1 in a perspective view from the rear.
Figure 17:
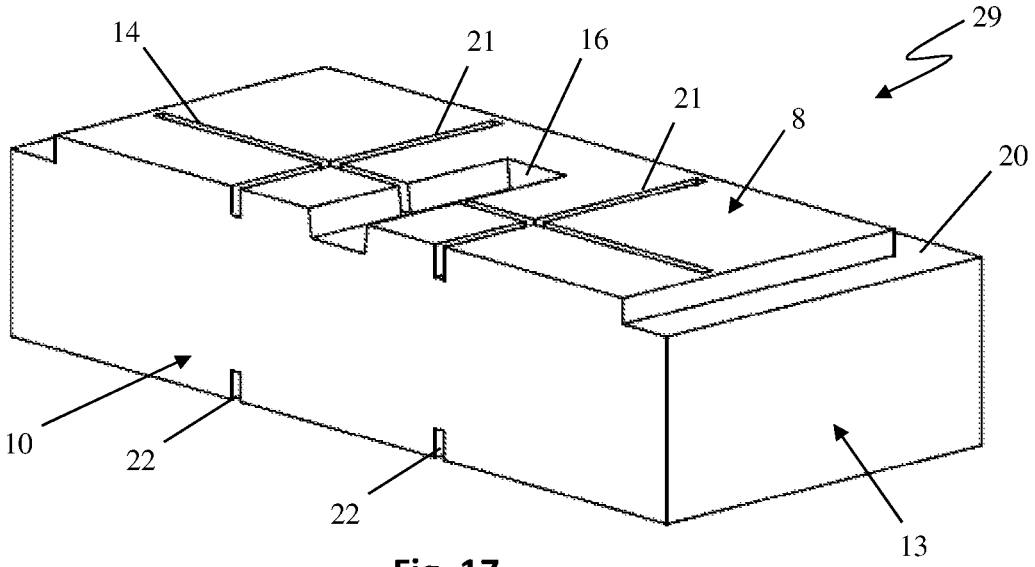
FIG. 17 shows a second alternative corner brick for the dry stacking system from FIG. 1 in a perspective view from the rear.

The dry stacking system (1) shown comprises four types of brick (2, 3, 4, 5), a first basic brick type (3) as an intermediate brick (3), a second brick type (2) as an anchoring brick (2), a third brick type (4) as a corner brick (4), and a fourth brick type (5) as a corner brick (5). A first alternative brick (27), which may also serve as a corner brick (27) of the dry stacking system (1), is shown in FIG. 16. A second alternative brick (29), which may serve as a corner brick (29) of the dry stacking system (1), is shown in FIG. 17.

The depicted bricks (2, 3, 4, 5, 27, 29) are hand-moulded bricks made of fired clay, but for example may also be produced as form casted bricks or water-struck bricks or natural stones or concrete bricks etc.

All these bricks (2, 3, 4, 5, 27, 29) are provided with a top face (8) and a bottom face (9) which are designed parallel to each other and flat as laying faces (8, 9). To make these bricks (2, 3, 4, 5, 27, 29) flat, these laying faces (8, 9) may for example be ground off.

Also, these bricks (2, 3, 4, 5, 27, 29) are provided with a groove (14, 15) in their top face (8) and in their bottom face (9), wherein the groove (14) in the top face (8) is arranged almost directly above the groove (15) in the bottom face (9). The grooves (14, 15) extend between the side faces (12, 13) of the bricks (2, 3, 4, 5, 27, 29) and in the case of intermediate bricks (3) and the first-mentioned anchoring bricks (2), also open into these side faces (12, 13). In the case of the corner bricks (4, 5, 27, 29), they do not open into the side face (12, 13) which is visible in a facade (26) formed therewith. These grooves (14, 15) each extend in the length direction of these bricks (2, 3, 4, 5, 27, 29).

Such grooves (14, 15) may also simply be produced as saw cuts.

By arranging locking elements (28) in the grooves (14, 15) of bricks (2, 3, 4, 5, 27, 29) stacked next to each other, the bricks (2, 3, 4, 5, 27, 29) can be fastened together. By means of such locking elements (28), in this way both bricks (2, 3, 4, 5, 27, 29) stacked next to each other and bricks (2, 3, 4, 5, 27, 29) stacked on top of each other can be fastened.

The depth of the grooves (14, 15) in the embodiment shown is selected such that there is still some tolerance for arranging such a locking element (28) therein. The depth of the groove (14) in the top face (8) is also delimited so as to ensure that a locking element (28) engaged in the groove (14) is also able to engage at least partly in a groove (15) in the bottom face (9) of a brick (2, 3, 4, 5, 27, 29) stacked on top.

Instead of allowing said grooves (14, 15) to open into the side faces (12, 13), these side faces (12, 13) may also for example alternatively be provided with corresponding recesses (16) for arrangement of such locking elements (28) for fastening together bricks (2, 3, 4, 5, 27, 29) stacked next to each other.

Furthermore, on one or more top edges which may be visible in the stacked state of these bricks (2, 3, 4, 5, 27, 29), these bricks (2, 3, 4, 5, 27, 29) are provided with a recess (20) in order to form a false joint between bricks (2, 3, 4, 5, 27, 29) stacked one above the other. It is namely often regarded as less aesthetically if hand-moulded bricks (2, 3, 4, 5, 27, 29), form casted bricks or other bricks (2, 3, 4, 5, 27, 29) with irregular forms provided with flat laying faces (8, 9) are stacked one upon the other. By forming such a recess (20) in the production mould, the edge below this false joint (20) has an irregular form. In this way, the illusion is created of a joint with an irregular form between bricks (2, 3, 4, 5, 27, 29) stacked one upon the other.

A first basic brick type (3), provided as an intermediate brick (3) for stacking between the other bricks (3), is configured completely in the manner described above. Such an intermediate brick (3) need not necessarily be present in the dry stacking system (1). Such an intermediate brick (3) may also easily be replaced in the dry stacking system (1) by an anchoring brick (2) as described below.

A second brick type (2), configured as an anchoring brick (2), is also provided for anchoring of a wall tie (6) therein. For this, the first-mentioned anchoring brick (2) depicted has four recesses (16) in its top face (8) for receiving the wall tie (6) therein. When a wall tie (6) is reached during stacking of the bricks (2, 3, 4, 5, 27, 29), such an anchoring brick (2) may be stacked at the level of this wall tie (6), wherein preferably the wall tie (6) can be arranged in one of these recesses (16). Such an anchoring brick (2) may be provided with one or more such recesses (16). In the second anchoring brick (29) depicted, a single recess (16) is provided. The longer the length of such an anchoring brick (2, 29), the more such recesses (16) can be provided. The shorter the length of such an anchoring brick (2, 29), the fewer such recesses (16) may be provided.

Each of these recesses (16) is substantially bar-shaped with a release chamfer, so that these recesses (16) can also be formed in the mould in which the hand-moulded brick (2, 29) is formed. These recesses (16) extend from the rear face (10) of this anchoring brick (2, 29) (into which they open) to beyond the corresponding groove (14) in the top face (8) of this anchoring brick (2). Viewed from the rear face (10) of this anchoring brick (2, 29), each recess (16) extends to beyond half the top face (8). A front upright edge (19) of the anchoring brick (2, 29) delimits each recess (16) on the front side so as to conceal this recess (16) and any wall tie (6) arranged therein. The width of each of these recesses (16) is at least three times the diameter d of the wall tie (6) and at most four times this diameter d, so that the wall tie (6) can be received neatly therein.

Each recess (16) is laterally delimited by upright edges (17, 18) which are produced over the full width so that the anchoring clamping element (7) described below can adequately engage in these upright edges (17, 18).

The depth of each recess (16) must be at least the diameter of the wall tie (6). In the embodiment shown, there is also around 5 mm tolerance so that the wall tie (6) can easily be arranged in this recess (16).

An anchoring clamping element (7) of the dry stacking system (1) shown is provided with two legs (24, 25) which are springy relative to each other so that this can be sprung-engaged in a groove (14) in the top face (8) of an anchoring brick (2, 29) and be clamped therein. Furthermore, this is also sufficiently springy to also be able to be arranged on the opposite side in a groove (15) on the bottom face (9) and be clamped therein. For this, such an anchoring clamping element (7) is preferably made of stainless steel. Alternatively, the anchoring clamping element (7) may for example also be made of a plastic which is selected in such a way that it can absorb the desired loads. The depicted anchoring clamping elements (7) are each provided with an anchor recess (23) for receiving the wall tie (6) therein. Alternatively, such an anchoring clamping element (7) may for example also be provided with several such anchor recesses (23), so that the wall tie (6) can be arranged optionally in any one of these anchor recesses (23). In the embodiments depicted, this anchor recess (23) opens at the underside of the anchoring clamping element (7). Alternatively, such anchor recess (23) may for example also open at the top side or at one of the lateral sides of this anchoring clamping element (7).

After arranging the wall tie (6) in such an anchor recess (23) in the anchoring clamping element (7), this anchoring clamping element (7) can be arranged in the groove (14) in the top face (8) of the corresponding anchoring brick (2). This anchoring clamping element (7) may thus engage in the groove (14), at the side next to the recess (16) in which the wall tie (6) is arranged, in the upright edges (17, 18) which delimit this recess (16), and in the part of this groove (14) which extends deeper below this recess (16) than the recess (16).

When a brick (2, 3, 4, 5, 27, 29) is arranged above this anchoring brick (2, 29) at the level of the recess (23) in which the wall tie (6) is arranged, the anchoring clamping element (7) will also engage in the groove (15) in the bottom face of this brick (2, 3, 4, 5, 27, 29).

Figure 18:
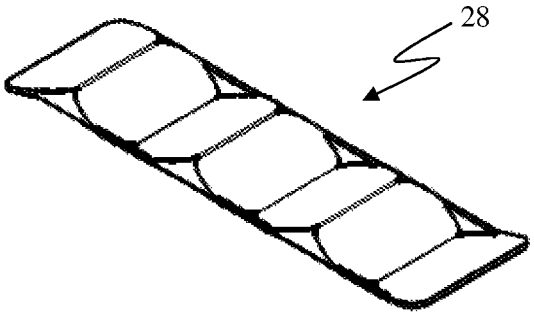
FIG. 18 shows a locking element for the dry stacking system from FIG. 1 in perspective.
Figure 19:
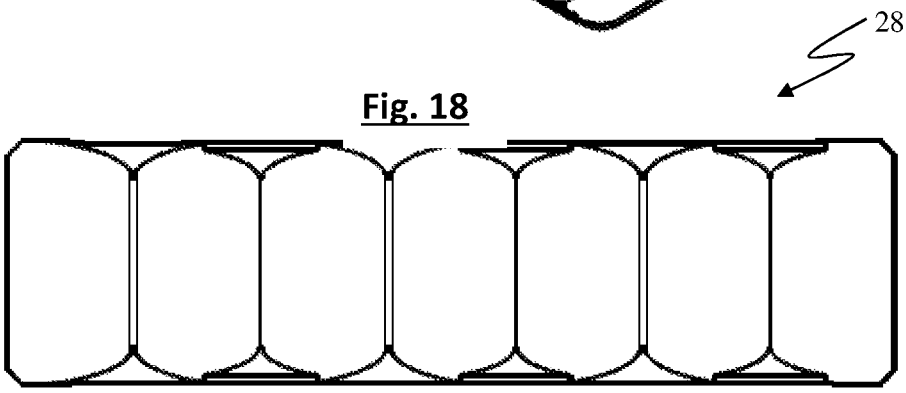
FIG. 19 shows the locking element from FIG. 18 in a front view.
Figure 20:
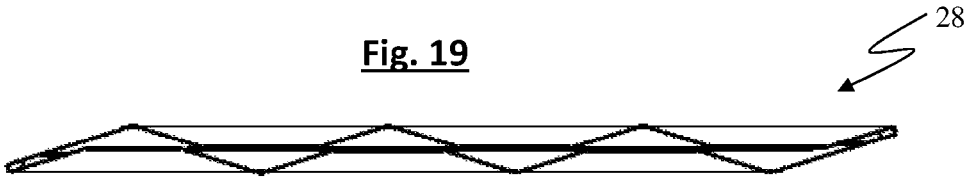
FIG. 20 shows the locking element from FIG. 18 in a top view.

The anchoring clamping elements (7) depicted may for example also be used as an aforementioned locking element for fastening together bricks (2, 3, 4, 5, 27, 29) stacked next to one another. However, another design of locking element (28) may also be provided, as shown in FIGS. 18 to 20. This locking element (28) is made from one piece of stainless steel which is folded concertina-like into a wafer form.

As an alternative to the anchoring element (7) or locking element (28) depicted, for example an anchoring element as described and shown in EP 1 412 588 B1 may also be selected, or a variant of this.

In the dry stacking system (1) depicted, preferably at least six anchoring clamping elements (7) are provided per square metre of façade (26). The locking elements (28) are situated in each layer of the stacked bricks (2, 3, 4, 5, 27, 29).

A third brick type (4) and a fourth brick type (5) are corner bricks (4, 5). The grooves (14, 15) in the top face (8) and the bottom face (9) of these corner bricks (4, 5), which extend between the side faces (12, 13) of these corner bricks (4, 5), only open into the corresponding side face (12, 13) on the invisible side of these corner bricks (4, 5). In addition, in their top face (8) and in their bottom face (9), these corner bricks (4, 5) are provided with corresponding transverse grooves (21, 22) which open into the joining faces (10, 11) of these bricks (4, 5) at a position in which these grooves (21, 22) can connect to grooves (14, 15) in the intermediate bricks (3) or anchoring bricks (2) stacked adjacent thereto.

The third brick type (4) and the fourth brick type (5) are designed as mirror images symmetrically with respect to a head side of this brick (4, 5).

Figure 1:
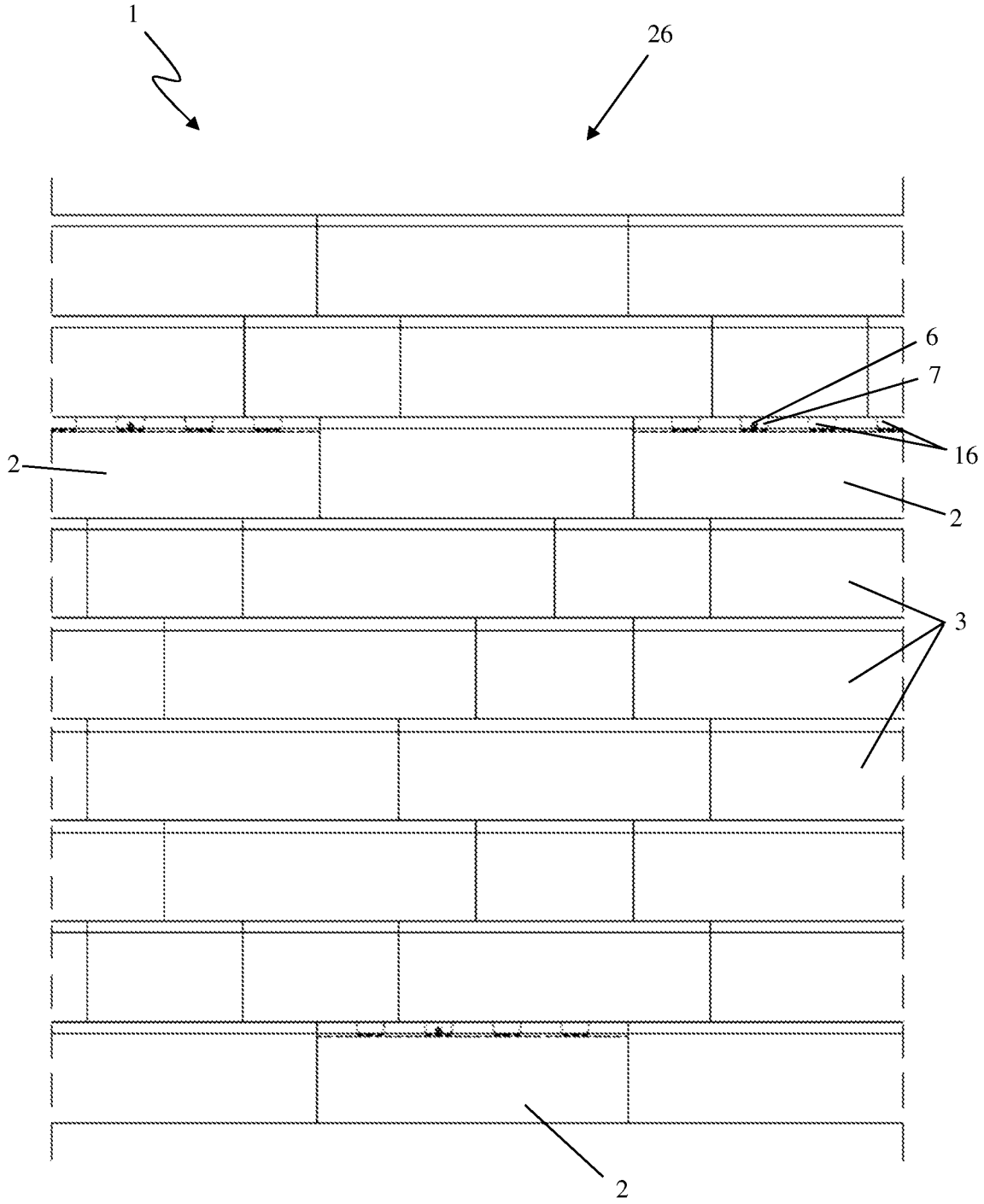
FIG. 1 shows a front view of a part of a facade erected with a dry stacking system according to this invention, with a groove and recesses in anchoring bricks according to this invention depicted in dotted lines, and wall ties arranged in recesses of these anchoring bricks.
Figure 2:
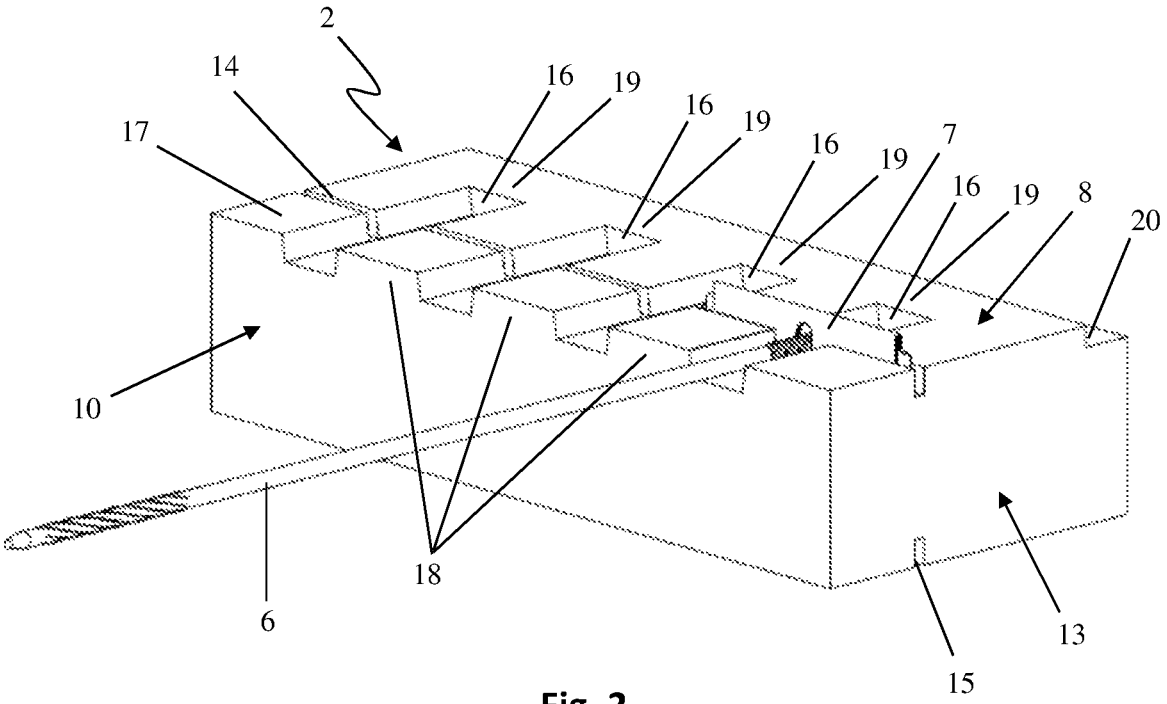
FIG. 2 shows in a perspective rear view how a wall tie with the anchoring clamping element is arranged in a recess of an anchoring brick of the dry stacking system from FIG. 1.
Figure 3:
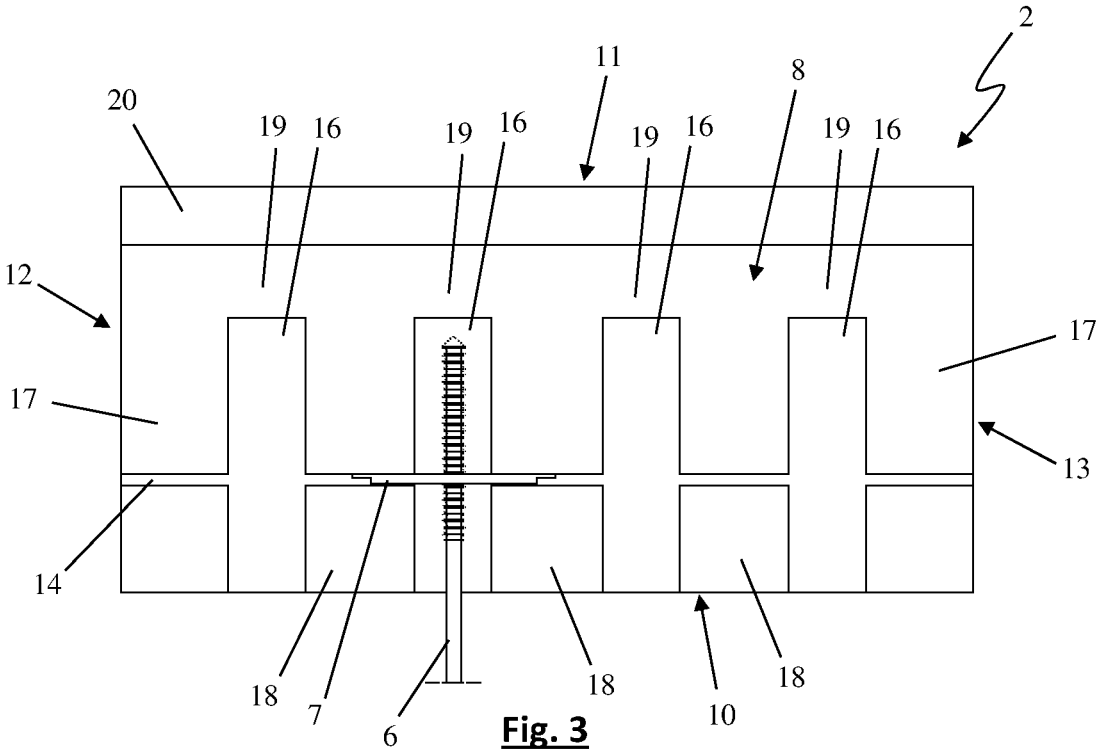
FIG. 3 shows a top view of the anchoring brick with wall tie and anchoring clamping element from FIG. 2.
Figure 4:
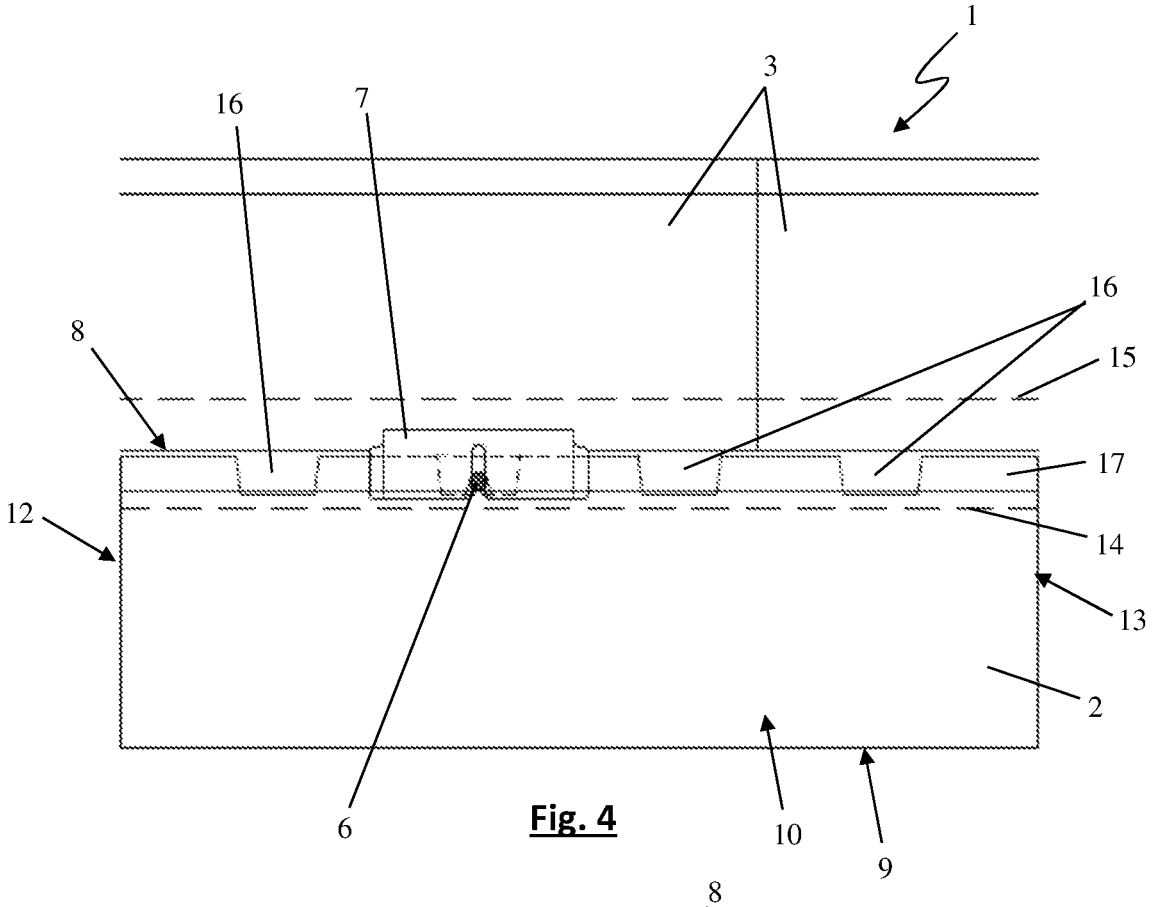
FIG. 4 shows part of the facade from FIG. 1 in more detail at the level of anchoring brick according to this invention.
Figure 5:
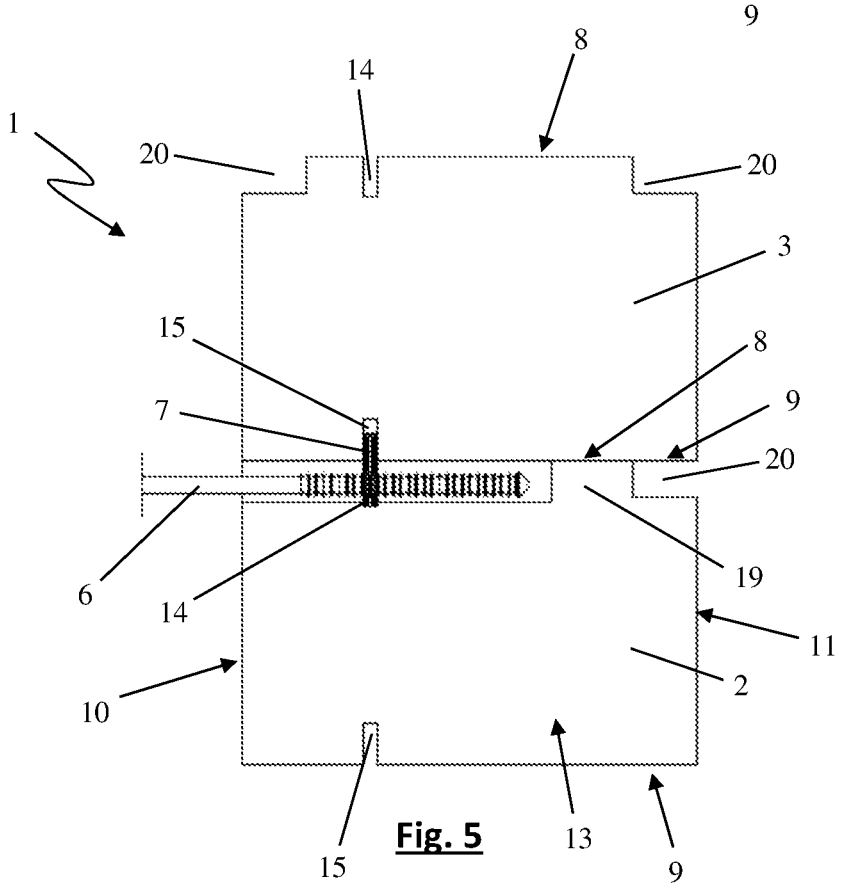
FIG. 5 shows two bricks from FIG. 1 in cross-section, cut through the recess in which the wall tie is arranged, next to the wall tie.
Figure 6:
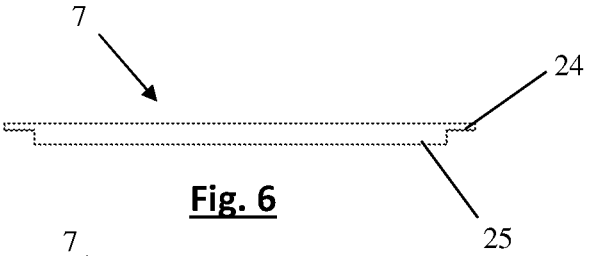
FIG. 6 shows the anchoring clamping element of the dry stacking system from FIG. 1 separately in a top view.
Figure 8:
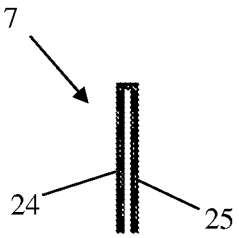
FIG. 8 shows the anchoring clamping element of the dry stacking system from FIG. 1 separately in a side view.
Figure 7:
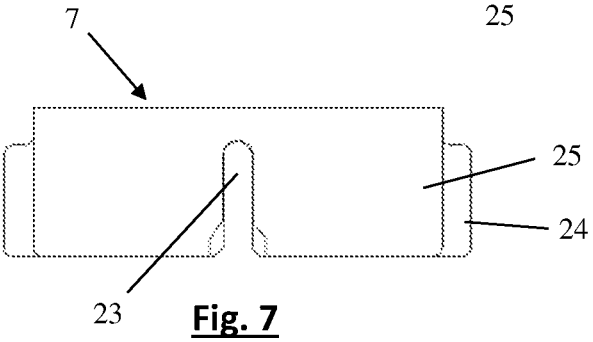
FIG. 7 shows the anchoring clamping element of the dry stacking system from FIG. 1 separately in a rear view.
Figure 9:
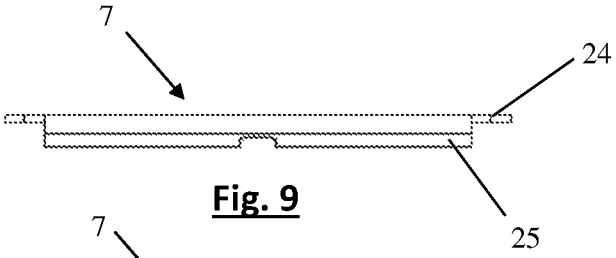
FIG. 9 shows an alternative embodiment of an anchoring clamping element for the dry stacking system from FIG. 1 in a top view.
Figure 11:
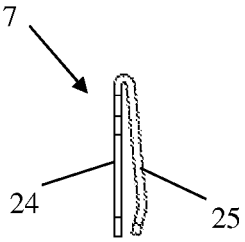
FIG. 11 shows the anchoring clamping element from FIG. 9 in a side view.
Figure 10:
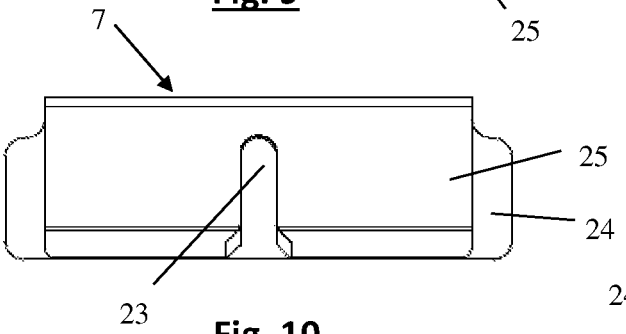
FIG. 10 shows the anchoring clamping element from FIG. 9 in a rear view.
Figure 12:
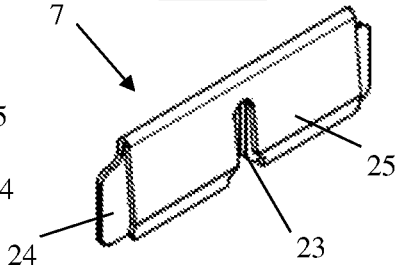
FIG. 12 shows the anchoring clamping element from FIG. 9 in a perspective view from the rear.
Figure 13:
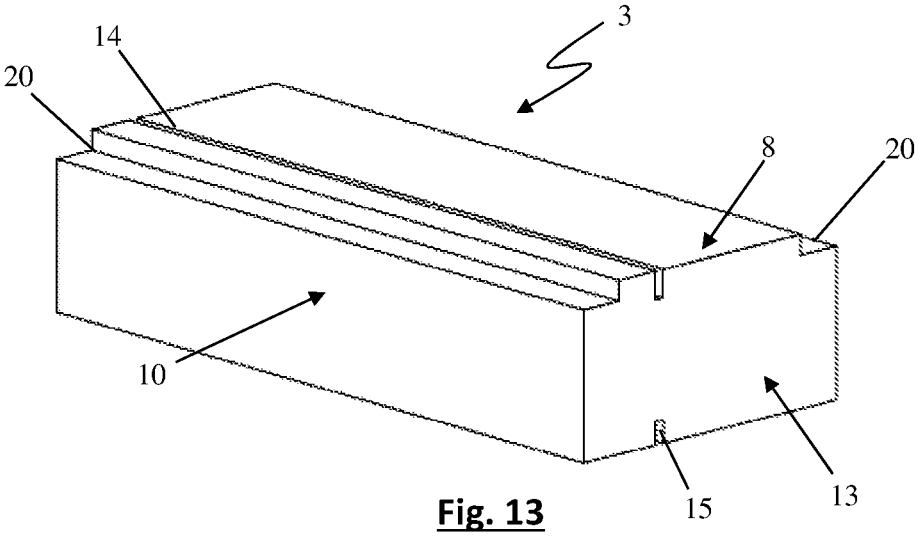
FIG. 13 shows an intermediate brick of the dry stacking system from FIG. 1 without recesses, in a perspective view from the rear.
Figure 14:
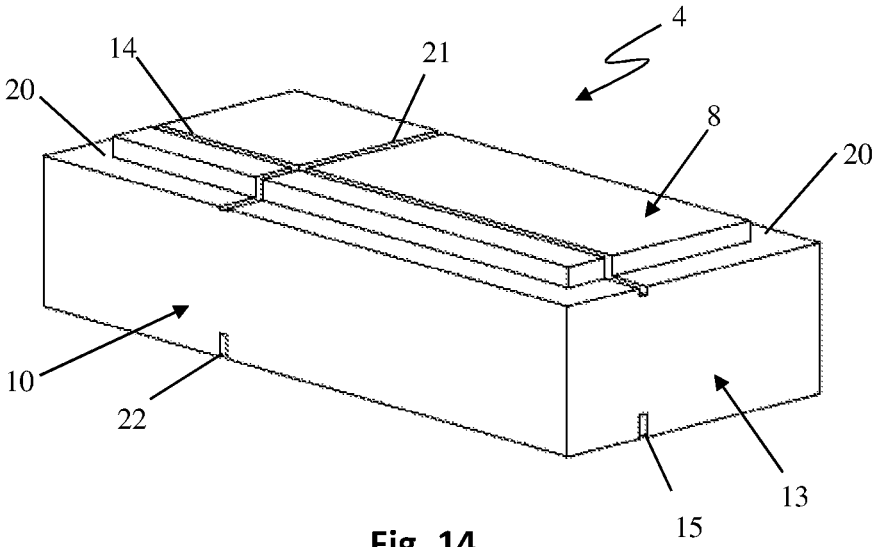
FIG. 14 shows a left corner brick of the dry stacking system from FIG. 1 in a perspective view from the rear.
Figure 15:
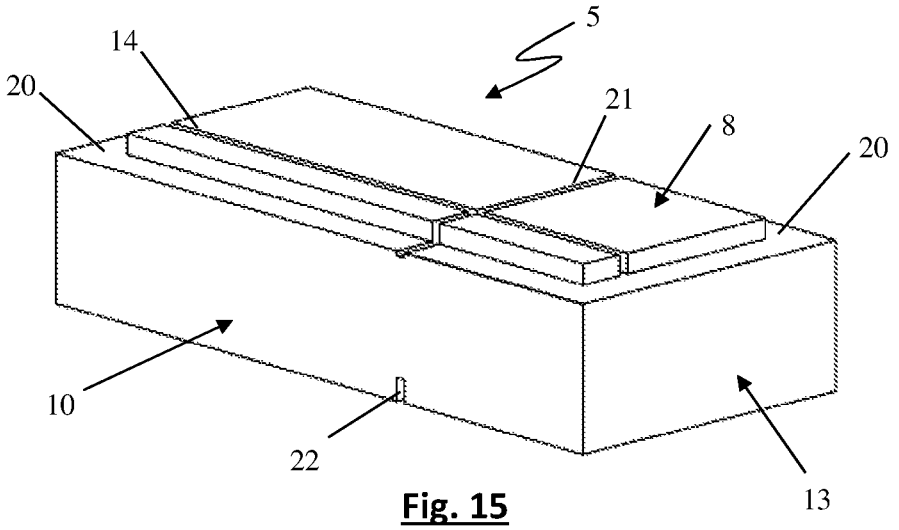
FIG. 15 shows a right corner brick of the dry stacking system from FIG. 1 in a perspective view from the rear.

In alternative embodiments, these corner bricks (4, 5) from FIGS. 10 and 11 may also be combined in a single alternative corner brick (27, 29) which is provided with the grooves (14, 15, 21, 22) of both corner bricks (4, 5). A first embodiment of such an alternative corner brick (27) is shown in FIG. 16, and a second embodiment of such an alternative corner brick (29) is shown in FIG. 17. In these alternative corner bricks (27, 29), the grooves (14) which extend in the length direction do not open into the side faces (12, 13).

In order to anchor these corner bricks (27, 29) to an intermediate brick (3) or anchor brick (2) arranged next to them at the side in their length direction, it is possible to cut off the respective end of this corner brick (27, 29), for example into a three-quarter brick, wherein the grooves (14-15) may then open into the newly formed side face. Such a corner brick (27, 29) may then be anchored to an intermediate brick (3) or anchoring brick (2) arranged next to this at the side by arranging a locking element (28) in the adjacent grooves (14, 15) of these bricks (27, 29, 3, 2).

Alternatively, it is also possible to anchor this corner brick (27, 29) indirectly to an intermediate brick (3) or anchoring brick (2) arranged next to this at the side via an intermediate brick (3) or anchoring brick (2) stacked above or below this. For this, firstly the first locking element is arranged in the adjacent grooves (14, 15) of this corner brick (27) and the intermediate brick (3) or anchoring brick (2) stacked above or below this, and secondly a second locking element is arranged in the adjacent grooves (14, 15) of the intermediate brick (3) or anchoring brick (2) arranged next to this at the side in the length direction and in the intermediate brick (3) or anchoring brick (2) stacked above or below this.

The second embodiment of the alternative corner brick (29) is also configured as an anchoring brick (29), and for this is provided with a single recess (16) in the same way as the anchoring bricks (2) described above.

The invention claimed is:

1. A dry stacking system with bricks for erection of a facade, comprising:

bricks, wherein each of said bricks has a top face and a bottom face which are configured to be flat in such a way that said bricks can be stacked with bottom faces of top-stacked bricks on top of top faces of under-stacked bricks, wherein the top face and the bottom face of each of said bricks have a groove which extends substantially in the length direction of said brick, in such a way that the groove in the bottom face of each top-stacked brick opens into corresponding grooves in the top face of the under-stacked bricks, and wherein at least one said brick is an anchoring brick that has one or more recesses configured for receiving a wall tie, each recess extending from a rear face of said anchoring brick to beyond the corresponding groove; and an anchoring clamping element which can be attached to the wall tie and arranged so as to be clamped in the adjacent grooves of a top-stacked brick and the corresponding under-stacked brick;

wherein each recess is provided in the top face or in the bottom face and in a depth direction perpendicular to the top face or the bottom face, is delimited by a bottom, and the dimensions of the one or more recesses in a length direction of the bricks are configured such that a plurality of possibilities exist for positioning the wall tie other than a position between side faces of adjacent bricks.

2. The dry stacking system according to claim 1, wherein each recess is formed substantially bar-shaped.

3. The dry stacking system according to claim 1, wherein each recess extends from the rear face of the anchoring brick, viewed towards a front face of the anchoring brick, to a certain distance from the front face.

4. The dry stacking system according to claim 1, wherein each recess is laterally delimited by upright edges of the anchoring brick, and that the upright edges and the anchoring clamping element are provided, on arrangement of the wall tie in each said recess and on clamping application of the anchoring clamping element in the corresponding groove, to cause said anchoring clamping element to engage with clamping effect in the corresponding groove in the corresponding upright edges on opposite sides of each said recess.

5. The dry stacking system according to claim 1, wherein the corresponding groove has a depth which is deeper than the depth of each recess.

6. The dry stacking system according to claim 5, wherein the corresponding groove and the anchoring clamping element are provided such that, on arrangement of the wall tie in each said recess and on clamping application of the anchoring clamping element in the corresponding groove, said anchoring clamping element engages with clamping effect in the corresponding groove at the bottom of each said recess.

7. The dry stacking system according to claim 1, wherein the anchoring clamping element is provided with an anchor recess in which the wall tie may be arranged in order to make the anchoring clamping element attachable to the wall tie.

8. The dry stacking system according to claim 7, wherein the anchoring clamping element has several said anchor recesses in which the wall tie can be arranged, wherein the several anchor recesses are spread over the length direction so that the anchoring clamping element is made attachable to the wall tie in several corresponding positions.

9. The dry stacking system according to claim 1, wherein at least one brick is configured as a hand-molded brick, a form casted brick, or a water-struck brick.

10. The dry stacking system according to claim 1, wherein at least one groove is formed as a saw-cut.

11. The dry stacking system according to claim 1, wherein each brick has a side face, such that the grooves originate from the side faces of the bricks and extend between the side faces of the bricks, and wherein the dry stacking system further comprises a locking element which can be arranged in adjacent grooves of bricks standing next to each other so as to fasten together the bricks standing next to each other.

12. A facade erected with the dry stacking system according to claim 1, wherein said wall tie of the dry stacking system is arranged in a said recess, and wherein said anchoring clamping element is attached to the wall tie and is arranged in grooves corresponding to the recess in top-stacked or under-stacked bricks.

13. A method for erecting a facade, using a dry stacking system according to claim 1, the method comprising:

stacking said bricks above the other, such that:

the anchoring brick with said recesses is arranged at the height of said wall tie, the anchoring clamping element is attached to the wall tie, the wall tie is arranged in a said recess, and the anchoring clamping element is arranged in grooves corresponding to the recess in top-stacked or under-stacked bricks.

* * * * *